United States Patent [19]

Borrup

[11] 4,384,401

[45] May 24, 1983

[54] METHOD FOR FORMING A HEATER ELEMENT

[75] Inventor: Ronald J. Borrup, South Pasadena, Calif.

[73] Assignee: Sierracin Corporation, Sylmar, Calif.

[21] Appl. No.: 312,685

[22] Filed: Oct. 19, 1981

Related U.S. Application Data

[62] Division of Ser. No. 101,215, Dec. 7, 1979, Pat. No. 4,320,286.

[51] Int. Cl.[3] ..... H01C 17/28

[52] U.S. Cl. ..... 29/611; 29/618; 29/621; 29/855; 29/857; 219/528

[58] Field of Search ..... 29/611, 618, 621, 856–859, 29/855; 219/528, 544, 541, 548, 549, 345; 338/301

[56] References Cited

U.S. PATENT DOCUMENTS

| | | | |
|---|---|---|---|
| 1,767,716 | 6/1930 | Stoekle | 338/301 |
| 2,761,042 | 8/1956 | Scott | 338/301 |
| 2,804,533 | 8/1957 | Nathanson | 219/345 X |
| 2,957,227 | 10/1960 | Scott | 338/301 X |
| 3,031,739 | 5/1962 | Boggs | 219/345 X |
| 3,265,858 | 8/1966 | MacGuire | 219/345 |
| 3,397,301 | 8/1968 | Hager, Jr. | 219/345 |
| 3,629,040 | 12/1971 | Hinton et al. | 29/611 |
| 3,745,309 | 7/1973 | Gruss | 219/522 |
| 3,790,752 | 2/1974 | Boaz et al. | 219/522 |
| 3,794,809 | 2/1974 | Beck et al. | 219/203 |
| 3,821,517 | 6/1974 | Erickson | 219/546 |
| 3,852,570 | 12/1974 | Tyler | 219/528 |
| 3,889,362 | 6/1975 | Tyler | 29/621 |
| 3,947,618 | 3/1976 | Gruss | 428/49 |
| 3,973,103 | 8/1976 | Tadewald | 219/543 |
| 4,037,082 | 7/1977 | Tamada et al. | 219/541 |

*Primary Examiner*—Carl E. Hall
*Assistant Examiner*—P. W. Echols
*Attorney, Agent, or Firm*—Christie, Parker & Hale

[57] ABSTRACT

There is provided a flexible electric heater element and a process for making such a heater element.

The flattened ends of two lead wires are disposed on a first layer of material which includes a vulcanizable elastomer. The ends of a resistance wire are placed in electrical contact with the flattened ends of the two lead wires. A second layer of material, which includes a vulcanizable elastomer, is placed over the first layer sandwiching between the layers the resistance wire in electrical contact with the flattened ends of the two lead wires. The other ends of the two lead wires extend externally to the first and second layers of material.

The elastomer is vulcanized and the flattened ends of the lead wires are held in permanent electrical contact with the ends of the resistance wire by forces exerted by the vulcanized elastomer.

17 Claims, 3 Drawing Figures

38
32
36
34
44
42
30
10
30
40
20
28
26
12
18
24
14
22
16

METHOD FOR FORMING A HEATER ELEMENT

CROSS REFERENCE TO RELATED APPLICATIONS

This is a division of application Ser. No. 101,215, filed Dec. 7,1979, now U.S. Pat. No. 4,320,286.

BACKGROUND OF THE INVENTION

This invention relates to flexible electric heater elements and, additionally, to a process for forming such a flexible heater element.

Flexible electric heating elements produced from flexible insulating materials molded or formed around various patterns of electrically conductive materials such as resistance wires are presently available. Electrical leads extend from such heating elements to provide for current flow through the resistance wire. The flow of current through the wire heats the wire and heat is thereafter conducted through the insulating material to perform the desired heating function.

Flexible electric heating elements are provided which are flat and are useful for heating objects of various sizes and shapes. For example, a flexible heating element can be used as a drum heater, wherein the heating element is wrapped around the drum to provide for direct contact between the drum and the entire heating surface of the heating element. This ability to be fitted to conform to the contours of the item desired to be heated provides for enhancing efficiency and, therefore, economics of a heating process.

Flexible electric heating elements are formed by placing a resistance wire on a sheet of elastic material, wherein the elastic material can, for example, be a vulcanizable elastomer. The resistance wire is formed into a pattern to be disposed on the elastic material by wrapping the resistance wire around a plurality of vertical pins which protrude from a base or the like. Disposing a resistance wire onto an elastic material can be accomplished using various techniques.

In one technique, the elastomer sheet is placed over the pins so that the pins pierce the elastomer and extend vertically therefrom. Wire is thereafter wrapped around the pins to form convolutions of wire which are disposed on the elastomer. The layer of elastomer having the wire disposed thereon is then removed from the pins for further processing.

Alternatively, a technique of using "disappearing pins" can be provided wherein wire is wrapped around the pins which extend from the base to form the desired wire pattern. Once the wire pattern is formed, the pins are lowered so as to "disappear", i.e., to be flush with the base. An elastomer sheet can thereafter be placed across the wires partially embedding the wires therein. The use of pins which can be lowered eliminates the problem of forming holes in an elastomer by a method such as that described hereinabove.

Lead wires are thereafter connected directly to the ends of the resistance wire by conventional means such as by soldering or by crimping. Crimping can be accomplished by using a pressure connector such as a hollow metal cylinder. An end of a lead wire and one of the ends of the resistance wire are inserted into the hollow metal cylinder and the hollow cylinder is thereafter crimped or crushed to form a permanent connection between the end of the lead wire and the end of the resistance wire.

Alternatively, the ends of a resistance wire can be welded to a metal plate and thereafter lead wires can also be welded to the metal plate to form the electrical connection between lead wires and the resistance wire.

The process of forming the resistance wire in the desired pattern to be disposed on an elastomer is an expensive and time-consuming process which limits the rate at which heater elements can be produced. Additionally, when pins are used and the elastomer is placed over the pins, holes are undesirably formed in the elastomer.

Also, the use of standard methods of connecting the lead wire to the resistance wire such as by soldering, crimping, or by welding to a metal plate or the like is an expensive process.

It is, therefore, desirable to provide a heater element which is economically manufactured by a process providing for enhanced efficiency of production and additionally providing for a less expensive means of permanently connecting lead wires to a resistance wire.

SUMMARY OF THE INVENTION

A heater element is provided which comprises a length of conductive material of a predetermined resistivity having a first end and a second end disposed on a first layer which comprises an elastomeric dielectric. One end of a first electrical lead forms a first electrical contact with the first end of the conductive material and the other end of the first electrical lead protrudes beyond the first layer. One end of a second electrical lead forms a second electrical contact with the second end of the conductive material and the other end of the second electrical lead protrudes beyond the first layer. A second layer comprising an elastomeric dielectric is disposed over the first and second electrical contacts and is bonded to the first layer. The first and second electrical contacts are permanently maintained solely by forces exerted by such an elastomeric dielectric.

The heater element can be formed by winding a resistance wire around the hollow core which includes at least an outer layer of elastomeric material for forming a coil of resistance wire around said hollow core. A pair of lead wires is placed spaced apart on a substrate of elastomeric material. The coil of resistance wire and the hollow core are flattened and the flattened coil and hollow core are placed on the substrate with one end of the coil of resistance wire in electrical contact with one lead wire and the other end of the coil of resistance wire in electrical contact with the other lead wire. A layer of elastomeric material is placed onto the substrate of elastomeric material and is bonded to the substrate of elastomeric material for maintaining the electrical contact between the ends of the coil of resistance wire and the lead wires.

DRAWINGS

These and other aspects of the invention will be more fully understood by referring to the following detailed description and accompanying drawings in which.

DETAILED DESCRIPTION

The flexible electric heater element of this invention comprises an electrically conductive material located between two layers or sheets of a flexible material. One or both of the layers can be composites or laminates and at least one of the layers of material comprises an elastomer. Various sizes and shapes of heater elements can be provided as desired.

Lead wires are provided which are held in permanent electrical contact with the electrically conductive material solely by forces exerted by the elastomer.

Figure 1:
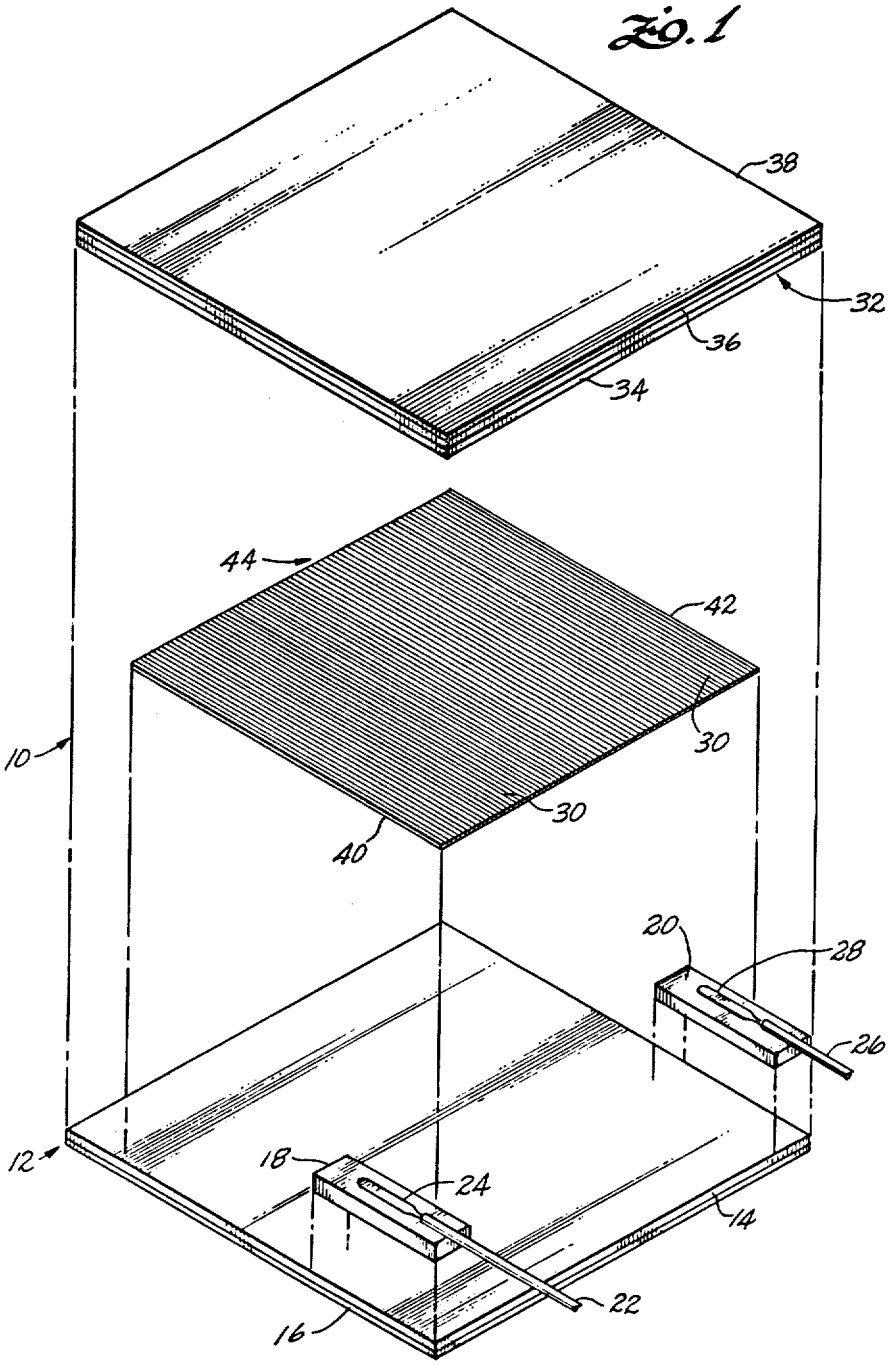
FIG. 1 is a semi-schematic exploded perspective view of a preferred embodiment of a heater element formed according to principles of this invention.

Referring to FIG. 1, there is shown a semi-schematic exploded perspective view of a preferred embodiment of a heater element 10 formed according to principles of this invention.

The heater element 10 comprises a first composite 12 which includes an upper layer 14 comprising a sheet of elastomeric material and a bottom layer 16 which comprises a material for supporting the upper layer of elastomeric material.

Additionally, a first insert 18 and a second insert 20, each comprising a pad or sheet of elastomeric material, are disposed on the upper layer 14.

A first lead wire 22 which has a flattened end 24 is disposed on the first insert 18 and the other end of the lead wire 22 protrudes beyond the edge of the first composite. A second lead wire 26 which has a flattened end 28 is disposed on the second insert 20 and the other end of the lead wire 26 protrudes beyond the edge of the first composite.

A resistance wire or heater filament 30 which is wrapped around a core comprising an elastomeric material and which is described in detail below is provided, wherein one end of the resistance wire is in electrical contact with the flattened end of the first lead wire and the other end of the resistance wire is in electrical contact with the flattened end of the second lead wire.

A second composite 32 which comprises a bottom layer 34 of elastomeric material, a middle layer 36 which comprises a material for supporting the second composite, and an upper layer 38 of elastomeric material is bonded facewise to the first composite 12 forming the heater element.

In a preferred embodiment, the upper layer 14 of the first composite 12 comprises silicone rubber as an elastomeric dielectric. Other elastomeric dielectric materials can also be used if desired, such as butyl rubber, neoprene rubber, and the like, The elastomeric dielectric chosen can depend upon factors such as the chemical, electrical, and temperature requirements of the heater element. The upper layer of silicone rubber provided is about 8 mils thick.

The bottom layer 16 of material comprises a layer of woven fiberglass strands forming a fabric which is about 4 mils thick. The fiberglass fabric supports the elastomeric material during processing and improves ease of handling of the silicone rubber in its pre-polymer or uncured form prior to vulcanization. Additionally, the fiberglass fabric provides a portion of the dielectric requirement and improves the strength of the heater element produced.

The layers of material used for forming such composites can have various thicknesses, depending upon the material composition of such layers, for providing a formed heater element that is economically produced and has the desired dielectric strength, while having desirable heat transfer characteristics.

One of the features of this invention is that the lead wires provided are held in electrical contact with the ends of the resistance wire solely by forces exerted by the elastomeric materials which comprise the heater element, as described hereinabove.

It can, therefore, be desirable to provide a sufficient amount of such an elastomeric material so that the contacts formed by the lead wires and by the resistance wire are sufficiently embedded within elastomeric material to enhance permanence of the contacts.

If desired, to provide for enhanced embedment of the electrical contacts, the upper layer 14 of silicone rubber can be increased in thickness. Alternatively, however, additional elastomeric material can be provided only in the region of the electrical contact made between the resistance wire and the lead wires, thereby reducing the amount of additional elastomer required, resulting in enhanced economics of manufacture of the heater element.

For example, the first composite 12 additionally comprises the first insert 18 and the second insert 20, both of which comprise silicone rubber and are disposed on the surface of the upper layer 14. The spacing between inserts and dimensions of each insert can be as desired to provide for additional embedment of electrical contacts. The spacing, size, and thickness of each insert can depend, for example, upon the size of the heater element being formed, the size, i.e., the diameter, of the wires used, and amount of additional embedment of the wire desired and other like factors.

In a preferred embodiment, the first and second inserts each comprise silicone rubber and have a thickness of about 15 mils. The inserts are about ¼ inch in width and have a length of about 1½ inches in a direction along the length of the lead wires. The inserts are spaced apart about 2⅜ inches on the surface of the upper layer 14 of silicone rubber.

If desired, inserts of elastomeric material need not be provided and the flattened ends of the lead wires can be disposed directly on the upper layer 14 of silicone rubber.

The lead wires provided can be stranded wires, but it is preferred that solid wire is used. The use of solid wire enhances the ease of assembly and additionally enhances electrical contact between lead wires and the resistance wire 30. Lead wires can have various diameters and be made of various materials, however, the lead wires used in the preferred embodiment are copper wires plated with nickel having a diameter of about 0.025 inches.

To enhance electrical contact with the resistance wire, the lead wires have contact ends which are flattened, as described hereinabove. For example, the lead wire 22 has a contact end 24 which is flattened and the lead wire 26 has a contact end 28 which is flattened.

The flattened end of the first lead wire 22 is positioned at a predetermined first location on the first composite 12 and the flattened end of the second lead wire 26 is positioned at a predetermined second location spaced apart from the first location on the first composite. The location chosen depends upon factors which include the length of the resistance wire or resistance wire assembly so that the ends of the resistance wire assembly or resistance wire contact the flattened end of the lead wires.

When inserts are used such as the inserts 18 and 20, described hereinabove, the flattened ends of the lead wires are positioned at predetermined locations on the inserts.

Each of the lead wires has a free end which extends external to the heater element to provide external electrical connections to said heater element.

In practice of principles of this invention, a first lead wire is in electrical contact with the first end of an electrically conductive material and a second lead wire is in electrical contact with the second end of the electrical conductive material.

In a preferred embodiment, the flattened end 24 of the first lead wire 22 is in electrical contact with one end 40 of the resistance wire 30, forming a first electrical contact. The flattened end 28 of the second lead wire 26 is in electrical contact with the other end 42 of the resistance wire 30, forming a second electrical contact.

It is desirable to provide a resistance wire and lead wires that comprise materials which are not readily oxidized to avoid degradation of electrical contact between such a resistance wire and the lead wires. The elastomeric material, i.e., the silicone rubber, is initially provided in its uncured form. During formation of the heater element, the elastomeric material is vulcanized and thereafter the lead wires provided are held in permanent electrical contact with such a resistance wire by forces exerted by the vulcanized elastomeric material. Both the resistance wire and lead wires are subjected to conditions during the vulcanization process which enhance oxidation of the wires and which could have a deleterious effect on electrical contacts formed between such a resistance wire and the lead wires, if readily oxidized materials were employed.

In an exemplary embodiment, the resistance wire 30 is a nickel wire having a diameter of about 0.004 inches, although, if desired, other types of wire can also be used. For example, Nichrome alloy wires comprising nickel, iron, carbon, and chromium or copper wires having a nickel coating thereon or the like can be used, if desired.

In the preferred embodiment, a resistance wire 30 is disposed on the surface of the upper layer 14 between the first composite 12 and the second composite 32. It is preferred that the resistance wire is provided in the form of a resistance wire assembly or heater filament assembly such as the resistance wire assembly 44 shown in FIG. 1.

Figure 2:
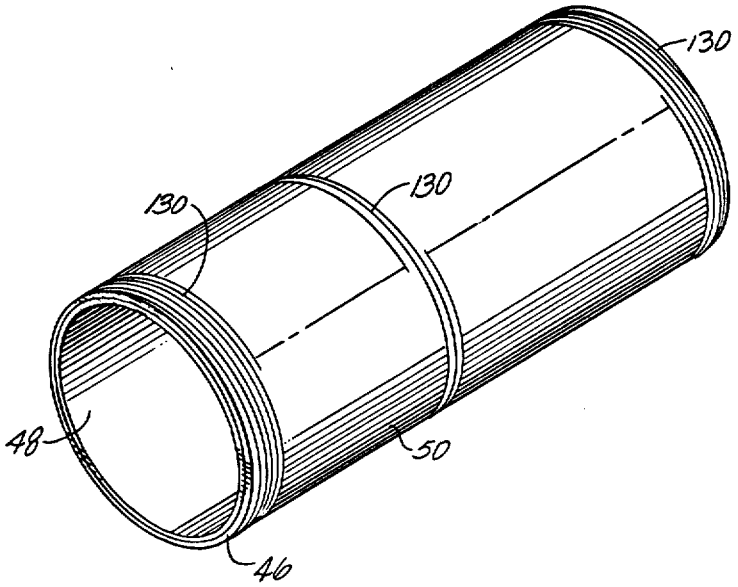
FIG. 2 is a semi-schematic perspective view of a preferred embodiment of a resistance wire assembly for use according to this invention.

A better understanding of a preferred resistance wire assembly can be achieved by referring to FIG. 2 which shows a semi-schematic perspective view of a resistance wire assembly formed according to practice of principles of this invention.

To form the resistance wire assembly 44, a laminate is provided which comprises a layer of an uncured elastomeric material bonded to a layer of woven fiberglass fabric. In one embodiment, for purposes of exposition herein, a laminate which is about 2 feet in length, about 5¼ inches wide, and about 7 mils thick is used. The laminate comprises a first layer 46 of uncured silicone rubber which is about 4 mils thick and a second reinforcing layer 48 of fiberglass fabric which is about 3 mils thick. The laminate is formed into a hollow, cylindrical core 50 over a mandrel with the fiberglass layer on the inside and the silicone rubber layer on the outside. A 0.004 inch diameter nickel resistance wire 130 is wrapped circumferentially around the outside of the hollow, cylindrical core 50. In an exemplary embodiment, the wire is wrapped at from about 34 to about 40 turns per inch, depending on the resistance of the wire, in order to obtain the desired total resistance of wire for forming each resistance wire assembly. In the exemplary embodiment, the total resistance for each resistance wire assembly is about 108 ohms.

After completion of the wrapping of said resistance wire around the hollow, cylindrical core 50, the core and coil of resistance wire or heater filament core is removed from the mandrel and is flattened. The flattened core and coil of resistance wire is thereafter cut into sections, each section having a length of about 2½ inches. Each of these 2½ inch sections has a width of about 2⅝ inches and comprises the resistance wire assembly 44 which is used in the preferred embodiment.

The resistance wire assembly initially comprises uncured silicone rubber and this uncured silicone rubber is vulcanized after the uncured heater element is formed as will be described below.

If desired, cylindrical cores having various other dimensions can be used to provide resistance wire assemblies having the same dimensions as the resistance wire assembly of the exemplary embodiment. Alternatively, resistance wire assemblies having other dimensions can be formed, as desired, depending upon the size of the heater element being formed and the like.

The total length of resistance wire provided by each resistance wire assembly for use in forming each heater element can be as desired to provide the desired amount of heating by each such heater element. For example, more or less wire can be provided, depending on the number of turns of resistance wire around the core, the spacing between turns of wire, the size of the core, and other like factors.

Although the electrically conductive material provided in the preferred embodiment is a resistance wire provided as a resistance wire assembly, the conductive material can alternatively, if desired, be a flattened ribbon or strip of metal or the like. When the electrically conductive material provided is a flattened ribbon or strip of metal, the flattened ribbon or strip is disposed on the surface of the upper layer 14 of silicone rubber in a series of convolutions, instead of being provided as such a resistance wire assembly.

There is also provided a second composite 32, as described hereinabove, which is bonded facewise to the first composite 12.

The second composite comprises a second elastomeric dielectric which is disposed over the first and second electrical contacts formed by the lead wires and resistance wire.

The second composite can comprise a plurality of layers as, for example, the composite 32 of the preferred embodiment comprises three such layers. The bottom layer or inner layer 34 comprises 4 mils of silicone rubber, the upper layer or outer layer 38 comprises 4 mils of silicone rubber, and a middle layer 36 comprises 7 mils of fiberglass fabric which is bonded between the first and second layers.

In the preferred embodiment, the elastomeric dielectric, i.e., the silicone rubber, is initially provided as an uncured pre-polymer. The bonding of the first composite to the second composite is effected by vulcanization of the silicone rubber.

Although both composites of the preferred embodiment comprise silicone rubber, heater elements can be provided wherein only one of the composites comprises an elastomeric material or, alternatively, one of the layers can initially comprise an uncured elastomeric material and the other layer can comprise a cured or vulcanized elastomeric material.

If only one of the composites is initially provided comprising an uncured elastomeric material, bonding of the first composite to the second composite can be effected by use of adhesives or the like. In this case, the silicone rubber provided by either one of the composites and by the hollow core 50 of the resistance wire assembly 44 can be sufficient to provide for permanent electrical contact between the flattened end of the lead wires and the resistance wire.

When the flattened ends of each lead wire are held in permanent electrical contact with the resistance wire solely by forces exerted by the silicone rubber, the need for time-consuming and expensive operations, such as forming contacts by soldering or crimping or the like, as described hereinabove, is eliminated. Additionally, by pre-forming the resistance wire assembly 44, time-consuming and expensive hand-forming of said resistance wire over pins or the like, as described hereinabove, is eliminated.

Figure 3:
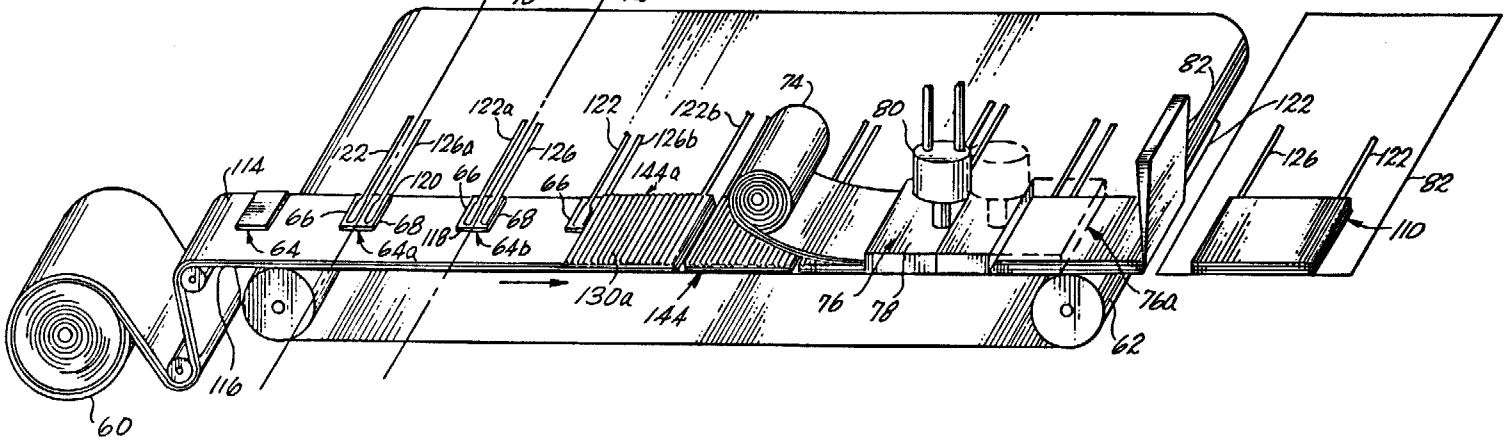
FIG. 3 is a semi-schematic perspective view showing a preferred embodiment of a process for making a heater element according to practice of principles of this invention.

Referring now to FIG. 3, there is shown a semi-schematic perspective view of a preferred embodiment of a process for producing a heater element such as the heater element 10 as shown in FIG. 1.

There is provided a roll of laminated material 60 from which at least a portion of the first composite 12 is formed. The laminated material provided has a layer 114 of uncured silicone rubber and a second layer 116 of fiberglass fabric. The laminated material is fed onto a conveyor 62, wherein the layer 114 of uncured silicone rubber is the top layer and the layer 116 of fiberglass fabric is the bottom layer and is in contact with the conveyor.

The conveyor is indexed, i.e., moved in a downstream direction, in sequential step increments. The increment is equal to the length of the heater element being made. For example, to make a heater element $2\frac{7}{8}$ inches long, each step increment is $2\frac{7}{8}$ inches.

During each shift or indexing of the conveyor, a pad 64 of uncured elastomeric material is placed on the surface of the layer 114 of uncured silicone rubber. Each pad is twice the width of the insert desired in the finished heater element and is later cut in half.

The first composite of material, therefore, comprises the upper layer 114 of silicone rubber, the bottom or outer layer 116 of fiberglass fabric, and periodic pads 64 of elastomeric material.

Two lead wires are thereafter placed on each pad of elastomeric material. The flattened end of a first lead wire 122 is placed about 0.03 inches from the trailing edge 66 of each pad 64 and the flattened end of a second lead wire 126 is placed about 0.03 inches from a leading edge 68 of each pad 64.

The other ends of the first and second lead wires extend external to the sandwich of laminar layers of material; that is, they extend external to the heater element, as described hereinabove.

Each heater element formed comprises two lead wires such as the first lead wire 22 and the second lead wire 26 as shown in FIG. 1.

At the downstream end of the conveyor, the laminated material is cut between adjacent lead wires on each pad so that one lead wire on each pad is for one heater element and the other lead wire on each pad is for the next heater element.

Although the laminated material and pads of material 64 are not cut until they proceed to the downstream end of the conveyor, for purposes of illustration herein, there is provided a first dashed line 70 and a second dashed line 72 which pass through the material where it will eventually be cut to form a heater element. The first dashed line 70 passes through the center of the elastomeric material pad designated **64*a* between the lead wires disposed on the pad 64*a* and the second dashed line 72 passes through the center of the elastomeric material pad designated 64*b* between the lead wires disposed on the pad 64*b*. That half of the pad 64*b* which has the first lead wire 122*a* disposed thereon forms the first insert 118 which is similar to the first insert 18 illustrated in FIG. 1. That portion of the pad 64*a* which has the second lead wire 126*a* disposed thereon forms the second insert 120 which is similar to the insert 20 shown in FIG. 1**.

Additionally, the process provides for placing the ends of a resistance wire in electrical contact with the flattened ends of the lead wires.

A resistance wire assembly 144 similar to the resistance wire assembly 44 shown in FIG. 1 is used for each set of first and second lead wires. For example, the resistance wire assembly designated **144*a* having a width of about $2\frac{1}{2}$ inches is placed onto the laminated material to provide one end of the resistance wire 130*a* in electrical contact with the flattened end of the first lead wire 122*b*. Additionally, the other end of the resistance wire 130*a* is placed in electrical contact with the flattened end of the second lead wire designated 126*b***.

A roll of laminated material 74 for forming the upper layer or composite 32 is positioned above the conveyor and feeds the second composite over the first composite, i.e., it is placed over the laminar material 60 and the pads 64 of elastomeric material.

In a preferred embodiment, the laminated material 74 comprises a first and second layer which comprise uncured silicone rubber and between the first and second layers, there is a layer comprising a fiberglass fabric. Placing the material 74 over the laminar material 60 and the pads 64 of elastomeric material thereby encloses between the first and second composites, i.e., between the laminated material 60 and the laminated material 74, the resistance wire assemblies and the first ends of the first and second lead wires.

The conveyor and materials placed thereon are indexed or moved downstream by an indexing assembly 76. The indexing assembly comprises a pressure plate 78 which is forced downwardly onto the outer surface of the laminar material 74 by a pneumatically operated plunger assembly 80, thereby compressing the layers of material, lead wires, and resistance wire assemblies. By compressing the layers of materials, the lead wires and resistance wires are held in electrical contact. Additionally, the indexing assembly moves forward while the pressure plate is exerting pressure on the surface of the sandwich of materials for moving the conveyor and sandwich of materials downstream a distance corresponding to the width of such a heater element to be formed.

The forward indexing is shown by the indexing assembly designated **76*a*** which is illustrated by dashed lines.

The pressure plate 78, after having indexed forward, is then lifted from the surface of the second composite 74 by the pneumatic cylinder and is thereafter moved upstream to its starting position.

Each time the conveyor and sandwich of material being formed thereon is indexed forward, a knife cuts through the sandwich of material to form an uncured heater element.

For example, the knife 82 operates to cut the sandwich of material between the first lead wire 122 on one heater element and the trailing side of the second lead wire 126 on the previous heater element. After the conveyor is indexed forward 2⅞ inches, the knife cuts through the material on the trailing side of an adjacent second lead wire 126 to form the uncured heater element 110.

The uncured heater element is thereafter removed from the table 82 at the end of the conveyor 62 and the uncured silicone rubber, i.e., the vulcanizable elastomer, is cured.

The cure of the heater element is accomplished by exerting a force on the surface of the first and second composites, thereby compressing the uncured heater element. The silicone rubber is heated to a sufficient temperature and for a sufficient time to cure silicone rubber. For example, it is sufficient to heat the silicone rubber to about 400° F. for about 1 minute to effect cure of the elastomer.

It is desirable that the silicone rubber used does not flow between the contact made by the lead wires and resistance wire during vulcanization.

The cured heater element can then be post-cured, if desired, by heating. This can preferably be accomplished by impressing a voltage across the second ends of the first and second lead wires. The heater element is thereby heated, preferably to about 420° F. for about 15 minutes, to drive off products of vulcanization such as mercaptans and the like.

In one exemplary embodiment in using a heater element formed by this process, the heater element is bonded to a flat metal surface to form a hot plate to warm various materials and the like.

This can be accomplished, for example, by taking an uncured heater element and by bonding it to a metal plate while simultaneously effecting cure of the silicone rubber. The bonding can be effected, for example, by priming the metal plate with a silane alcohol solution. The silane alcohol used can, for example, be Chemlok 607 produced and marketed by Hughson Chemical Company—Lord Corporation, Erie, Pennsylvania.

After the metal is primed, the outer layer 38 of the second composite 32 is pressed against the surface of the metal and the elastomer is vulcanized.

The above description of a heater element and method for producing such a heater element is for illustrative purposes. Because of variations which will be apparent to those skilled in the art, the present invention is not intended to be limited to the particular embodiments described hereinabove. The scope of the invention is defined in the following claims.

What is claimed is:

1. A method of making a heater element comprising the steps of:

(a) winding an electrically conductive resistance wire around a hollow core which includes at least an outer layer of elastomeric material for forming a heater filament coil of resistance wire around said hollow core;

(b) placing a pair of lead wires spaced apart on a substrate of elastomeric material;

(c) flattening the heater filament coil of resistance wire and the hollow core;

(d) placing the flattened heater filament coil of resistance wire and flattened hollow core on the substrate with one end of the heater filament coil in electrical contact with one lead wire and the other end of the heater filament coil in electrical contact with the other lead wire;

(e) placing a layer of elastomeric material onto the substrate of elastomeric material so that the electrical contacts made by the lead wires and the ends of the heater filament coil are sandwiched between the layer of elastomeric material and the substrate; and (f) bonding the layer of elastomeric material to the substrate of elastomeric material for permanently maintaining electrical contact between the ends of the heater filament coil and the lead wires solely by forces exerted by such elastomeric material.

2. The method according to claim 1 wherein the elastomeric material comprises silicone rubber.

3. The method according to claim 1 comprising bonding the layer of elastomeric material to the substrate of elastomeric material by vulcanizing said elastomeric material.

4. A method for forming a heater element comprising the steps of:

(a) providing a first composite comprising an elastomeric dielectric;

(b) positioning a first end of a first lead wire at a predetermined first location on the first composite and positioning a first end of a second lead wire at a predetermined second location on said first composite spaced apart from such a predetermined first location;

(c) placing one end of an electrically conductive heater filament in electrical contact with the first end of the first lead wire and placing the other end of the electrically conductive heater filament in electrical contact with the first end of the second lead wire;

(d) placing a second composite over the first composite, thereby enclosing between said first and second composites the first ends of the first and second lead wires and the electrically conductive heater filament such that the second ends of the first and second lead wires extend externally of the heater element; and (e) bonding the first and second composites facewise together sufficiently for maintaining the first and second lead wires in permanent electrical contact with the electrically conductive heater filament solely by forces exerted by such elastomeric dielectric.

5. The method according to claim 4 wherein the elastomeric dielectric comprises an uncured vulcanizable elastomer and wherein the process comprises bonding the first and second composites together by heating said uncured vulcanizable elastomer to a sufficient temperature for a sufficient time to cure the elastomer.

6. The method according to claim 4 wherein the second composite comprises an elastomeric dielectric.

7. The method according to claim 4 wherein the firt composite and the second composite each comprise at least one layer of an elastomeric dielectric and a layer of fiberglass fabric.

8. The method according to claim 6 wherein the elastomeric dielectric of the first composite and the elastomeric dielectric of the second composite each comprise a vulcanizable elastomer.

9. The method according to claim 8 wherein the vulcanizable elastomer comprises silicone rubber.

10. The method according to claim 4 wherein the first and second lead wires are solid wires.

11. The method as claimed in claim 10 wherein the first end of the first lead wire and the first end of the second lead wire are flattened in the region of electrical contact.

12. The method as claimed in claim 5 comprising the additional step of bonding the heater element to a substantially flat metal surface while simultaneously curing the vulcanizable elastomer.

13. The method as claimed in claim 12 comprising the additional step of post-curing the elastomer by impressing a voltage across the second ends of the first and second lead wires, thereby causing the electrically conductive heater filament to heat the vulcanizable elastomer, the voltage being impressed for a sufficient time to post-cure said elastomer.

14. A method for forming a heater element comprising the steps of:

(a) advancing a first composite comprising an uncured vulcanizable elastomer along a conveyor;

(b) positioning a flattened end of a first lead wire at a predetermined first location on the first composite and positioning a flattened end of a second lead wire at a predetermined second location on said first composite, said second location spaced apart from said first location;

(c) forming a heater filament assembly by:

(i) wrapping an electrically conductive resistance wire circumferentially around a hollow, cylindrical core, wherein the hollow, cylindrical core comprises an uncured vulcanizable elastomer, thereby forming a heater filament coil of resistance wire around said hollow, cylindrical core;

(ii) flattening the hollow, cylindrical core and the heater filament coil of resistance wire for forming the heater filament assembly having a first end spaced apart from a second end, the first end including one end of the heater filament coil of resistance wire and the second end including the other end of the heater filament coil of resistance wire;

(d) placing such a flattened heater filament assembly onto the advancing first composite for providing the first end of the heater filament assembly in electrical contact with the flattened end of the first lead wire and the second end of the heater filament assembly in electrical contact with the flattened end of the second lead wire;

(e) advancing a second composite comprising an uncured vulcanizable elastomer in a direction parallel to the direction of advance of the first composite and disposing the second composite facewise over the first composite, said first and second composites forming the outer layers of the heater element, thereby enclosing between said first and second composites the first and second ends of the heater filament assembly and the flattened ends of the first and second lead wires, and leaving the second ends of both the first and second lead wires extending externally of the heater element;

(f) cutting through the first and second composites at a location on the advancing side of such a first lead wire and on the trailing side of an adjacent second lead wire for providing an uncured heater element;

(g) curing the vulcanizable elastomer of the uncured heater element by:

(i) exerting a force on the surface of the first and second composites, thereby compressing said uncured heater element; and (ii) heating the vulcanizable elastomer to a sufficient temperature for a sufficient time for curing said vulcanizable elastomer, the cured elastomer providing forces which act alone to hold the first end of the heater filament assembly in permanent electrical contact with the flattened end of the first lead wire and to hold the second end of the heater filament assembly in permanent electrical contact with the flattened end of the second lead wire.

15. The method as claimed in claim 14 wherein the vulcanizable elastomer comprises silicone rubber.

16. The method as claimed in claim 14 comprising the additional step of post-curing the elastomer by impressing a voltage across the second ends of the first and second lead wires, thereby causing the resistance wire of the heater filament assembly to heat the elastomer, the voltage impressed for a sufficient time to post-cure said elastomer.

17. The method as claimed in claim 14 wherein the first and second lead wires are solid wires.

* * * * *